United States Patent [19]

Kiefer, Jr.

[11] Patent Number: 4,546,676

[45] Date of Patent: Oct. 15, 1985

[54] TORQUE-MULTIPLYING HAND WRENCH

[75] Inventor: Walter J. Kiefer, Jr., Bothell, Wash.

[73] Assignee: Kiefer Tool Co., Inc., Costa Mesa, Calif.

[21] Appl. No.: 600,887

[22] Filed: Apr. 16, 1984

[51] Int. Cl.[4] ..... B25B 13/00

[52] U.S. Cl. ..... 81/58.1; 81/63; 81/63.2

[58] Field of Search ..... 81/58, 58.1, 57.39, 81/60–63.2

[56] References Cited

U.S. PATENT DOCUMENTS

| | | | |
|---|---|---|---|
| 1,418,161 | 5/1922 | Pease . | |
| 2,510,483 | 6/1950 | Schnepel et al. . | |
| 2,711,110 | 6/1955 | Brame | 81/58.1 |
| 2,972,919 | 2/1961 | Stalkup . | |
| 3,256,758 | 6/1966 | Medesha . | |
| 3,529,498 | 9/1970 | Northcutt . | |
| 3,621,738 | 11/1971 | Northcutt . | |
| 4,091,890 | 5/1978 | Wilmeth et al. . | |
| 4,304,157 | 12/1981 | Yamada et al. . | |
| 4,339,968 | 7/1982 | Krieger | 81/57.39 |
| 4,377,955 | 3/1983 | Muller . | |

*Primary Examiner*—James G. Smith

*Attorney, Agent, or Firm*—Christensen, O'Connor, Johnson & Kindness

[57] ABSTRACT

A torque-multiplying hand wrench incorporating the features of a standard ratchet wrench along with a lever action torque multiplying feature. A torque multiplying lever arm is attached to a cam element, the eccentric of which acts upon yoke-shaped actuator when the lever arm is rotated. The actuator interacts with a standard ratchet device to apply torque to a threaded fastener. The handle of the wrench acts either as a standard ratchet wrench handle or as a reaction arm in conjunction with use of the torque multiplying lever arm.

10 Claims, 8 Drawing Figures

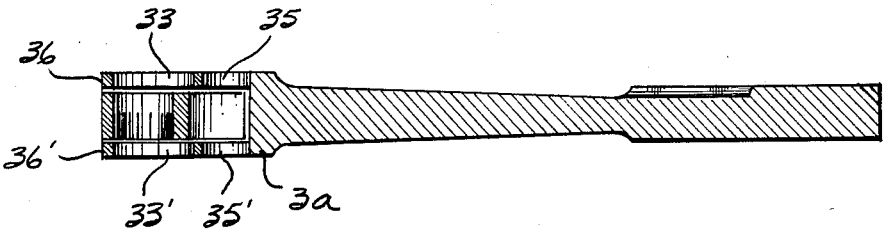
Fig. 3.
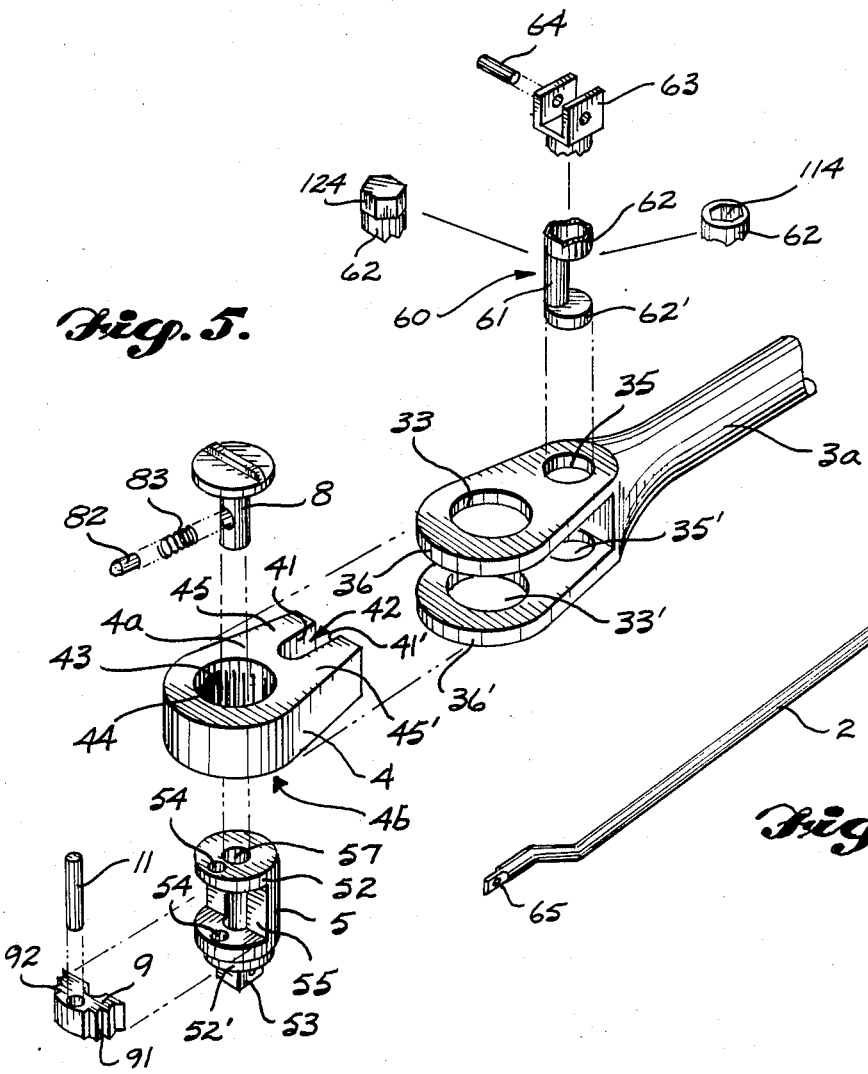
Fig. 5.
Fig. 4.

TORQUE-MULTIPLYING HAND WRENCH

BACKGROUND OF THE INVENTION

This invention relates to hand-operated, torque-multiplying wrenches and particularly to such wrenches equipped with ratchet devices.

Standard hand ratchet wrenches provide useful leverage for the process of driving or removing threaded fasteners. When it is necessary to dislodge a recalcitrant threaded fastener from the workpiece or to firmly set a fastener into the workpiece, the needed torque requirements often exceed that available from a standard hand wrench. Lever action, torque-multiplying wrenches are exemplified by Muller, U.S. Pat. No. 4,377,955, and Stalkup, U.S. Pat. No. 2,972,919. These wrenches generally do not combine the torque-multiplying feature with a truly compact and versatile ratchet wrench.

It is an object of this invention to provide a wrench that efficiently combines the mechanical structure necessary for delivery of very high torque with the normal useful features of a standard-sized, hand-powered ratchet wrench.

An additional object is to provide high torque capability through the use of a torque arm where that arm can be initially positioned in one of several orientations relative to the handle or "reaction" arm depending upon the limitations or requirements of the work space.

SUMMARY OF THE INVENTION

In accordance with the foregoing objects and other objects that will become apparent to one of ordinary skill upon reading the following specification, the present invention provides a torque-multiplying hand wrench that has an elongate handle or reaction arm. Rotatably attached to one end of the reaction arm is a drive member and a drive member actuation means that is shaped to engage a cam means that is rotatably mounted on the handle adjacent the drive member. The cam means and the drive member rotate about separate axes that are substantially parallel to each other. An eccentric portion of the cam means engages the drive member actuation means in a manner such that when torque is applied to the cam means relative to the reaction arm, the force is transferred and multiplied by the force moment associated with the cam and drive member actuation means thereby causing multiplied torque force to be applied to the drive member.

In the preferred embodiment, the drive member actuation means is coupled to the drive member by a ratchet device, the torque is applied to the cam means through the use of an elongate torque application arm that is connected to the cam means. The torque application arm can be rotated into alignment with the reaction arm forming a single extension that is used in the normal fashion as a wrench handle. When it is necessary to apply the very high torque generated by the wrench, the reaction arm can be braced against any load bearing object. The torque arm is then positioned, using the ratchet, to allow the most effective (power versus turning rate) application of force to that arm in relation to the reaction arm. The present invention thus provides a convenient wrench which combines a high torque capability with a standard ratchet wrench, allowing the same wrench to perform both functions.

BRIEF DESCRIPTION OF THE DRAWINGS

A further understanding of the invention can be derived by reading the following specification in conjunction with the accompanying drawings wherein:

FIG. 3 is a sectional view of the wrench handle and the drive member actuator;

FIG. 4 is an isometric view of the torque application handle;

FIG. 5 is an exploded view of the driving end portion of the wrench;

DETAILED DESCRIPTION OF THE INVENTION

Figure 1:
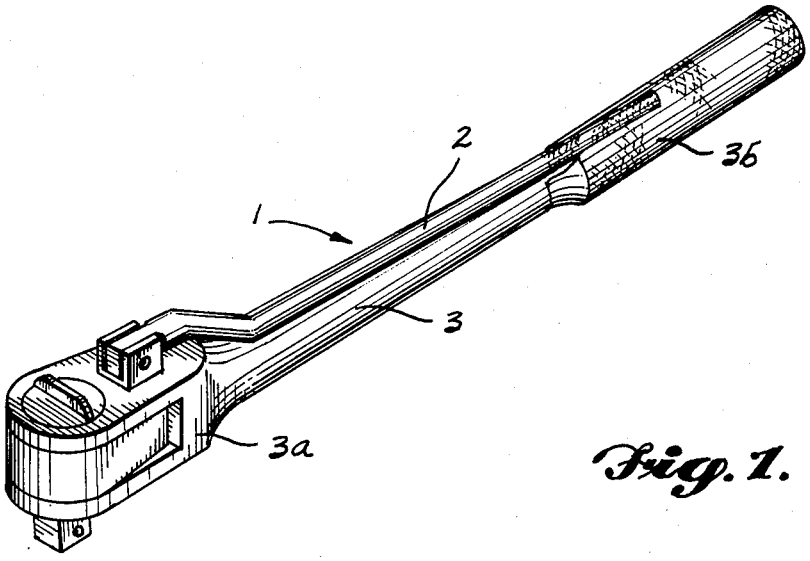
FIG. 1 is an isometric view of the wrench constructed in accordance with the invention.
Figure 2:
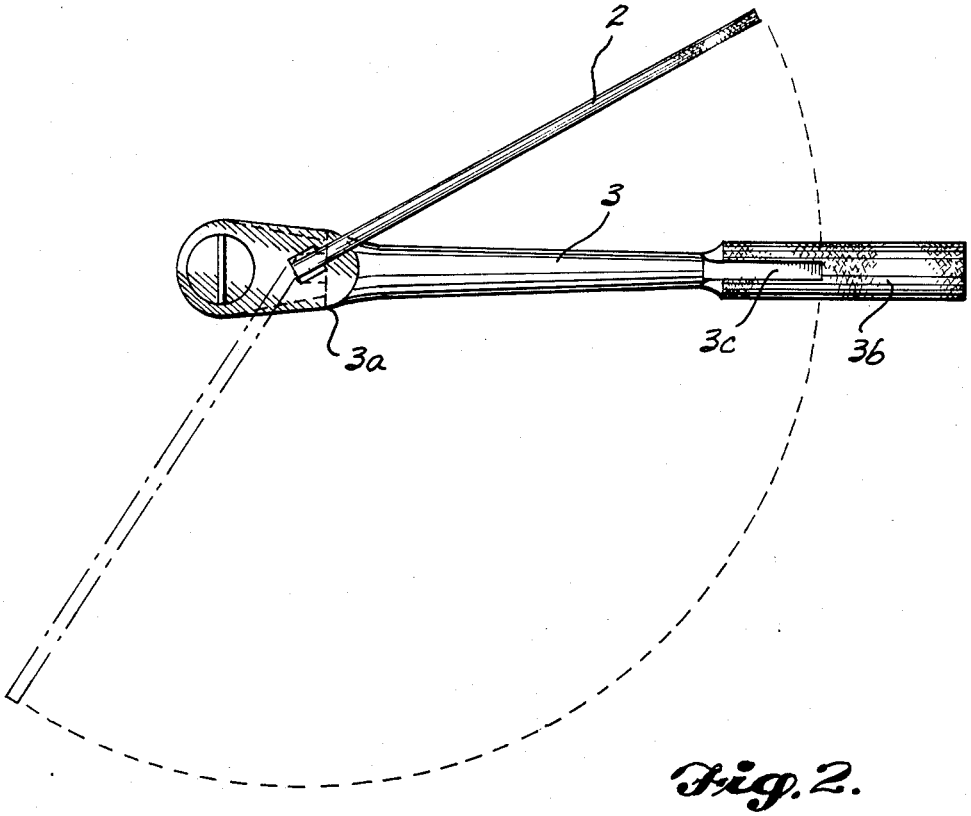
FIG. 2 is a top plan view of the wrench.
Figure 6:
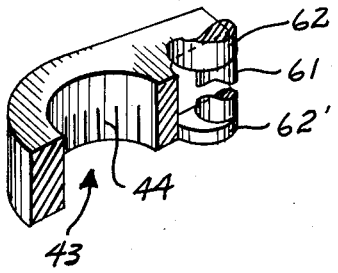
FIG. 6 is a partial sectional view showing the relationship between the cam member and the yoke of the drive member.

Referring first to FIGS. 1, 2 and 3, the wrench 1 comprises an elongate handle 3 which has a drive end 3*a* and a grip end 3*b*. The grip end 3*b* is knurled to ensure a firm gripping surface.

Referring now to FIG. 5, the drive end 3*a* of the handle is bifurcated to form a clevis consisting of substantially flat upper and lower clevis portions 36 and 36' that are spaced in substantially parallel relationship. The upper clevis portion 36 has two spaced bores 33 and 35 extending through the entire thickness of the portion 36. Each bore is circular with the bore 33, at the drive end, being of slightly greater diameter than bore 35. The lower clevis surface 36' has two substantially matching, spaced bores 33' and 35' that are concentric with bores 33 and 35, respectively. The diameter of bore 33' in the lower clevis portion 36' is slightly greater than the diameter of the upper bore 33 in portion 36.

Camming member 60 resides within the cylindrical bores 35 and 35' and comprises two cylindrical journals 62 and 62' of equal diameter joined together by a cylindrical eccentric 61 disposed in an eccentric relationship with the longitudinal centerline of the two journals 62 and 62'. The eccentric 61 has a diameter less than that of the two journals 62 and 62'. The camming member 60 is positioned so that the eccentric 61 is spaced in the opening formed between the upper and lower clevis portions 36 and 36'.

A yoke-shaped drive member actuator 4 is also located between the upper and lower clevis portions 36 and 36'. The drive member actuator 4 has substantially flat and parallel upper and lowr surfaces 4*a* and 4*b*. The thickness of the member between those surfaces is approximately equal to the space between the upper and lower clevis portions. One end of the drive member actuator 4 is substantially annular shaped with a cylindrical opening 43 extending therethrough. The centerline of the opening 43 is concentric with the centerline of the bores 33 and 33'. The interior portion of the cylindrical opening 43 is scored with longitudinal ratchet teeth 44 along its surface.

Extending from the annular end of the drive member actuator 4 are two legs 45 and 45' of the yoke. The exterior sides of the yoke legs form tangential extensions of the exterior annular surface surrounding cylindrical opening 43 and converge to form a generally tapered end of the drive member actuator 4. Yoke legs 45 and 45' are separated by an elongated slot 42 having substantially parallel interior sides 41 and 41'. The width of the slot 42 is slightly larger than the diameter of eccentric 61. When assembled, the drive member actuator 4 is positioned so that cylindrical opening 43 is concentric with the bores 33 and 33' and eccentric 61 is received between sides 41 and 41' of slot 42 of the yoke legs 45 and 45'. Since slot 42 is of a width less than a diameter of journals 62 and 62', the yoke legs of drive member actuator 4 hold the camming member 60 in place within the bores 35 and 35'.

A drive member 5 is coupled through ratchet device 50 to be driven by actuator 4. For this purpose, ratchet device 50 resides within the cylindrical void formed by bores 33, 33' of the clevis and opening 43 of the drive member actuator. Drive member 5 comprises a substantially cylindrical body having bearing surfaces 52 and 52' journaled in bores 33 and 33', respectively. The ratchet device 50 includes a pawl 9 pivotally attached by a retaining pin 11 to the body of drive member 5. The pawl 9 has teeth 91 and 92, either of which can be forced against the ratchet teeth 44 on the interior side of the cylindrical opening 43 of the drive member actuator 4. A pawl-reversing control 8 extends into the center of drive member 5 and provides for the positioning of a spring-biased reversing pin 82 which in turn causes one or the other set of pawl teeth 91 or 92 to interact with the ratchet teeth 44 of the drive member 4 and thus forcing the rotation of drive member 5 and output stub 53 when drive member actuator 4 is oscillated about its axis.

A bracket 63 is formed in the top of cam member 60, and torque application arm 2, which has an aperture 65 extending through one end, is hingedly attached to the bracket 63 with pin 64. The other end of torque arm 2 can be nested in the recess 3c formed in the grip end of handle 3. When the torque arm is in this position, the wrench will function similarly to a conventional ratchet wrench with a reversing pawl mechanism.

Figure 7:
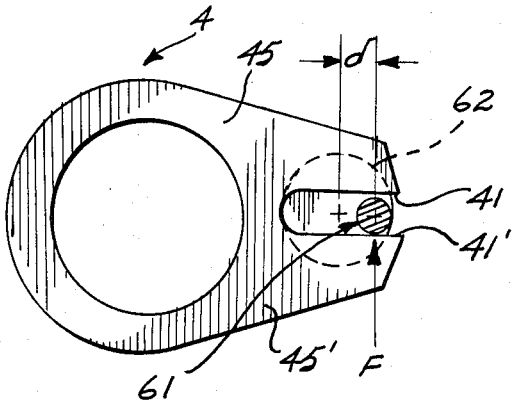
FIGS. 7 and 8 are partial plan views showing the camming action upon the drive member actuation means.

In addition to the conventional capability just described, the wrench also has the capability of delivering high torque tightening or loosening forces to threaded fasteners. The operation of the wrench in this mode is now described. In order to apply the most torque to the output stub 53 of the drive, the ratchet handle 3 is rotated until it rests against a load bearing, interfering object. In this position, the handle 3 will act as a reaction arm. After the main handle is positioned, the torque arm is released from its recess 3c and force is applied to the outermost portion of the torque arm. The force on the torque arm 2 is translated through the bracket 63, thereby causing rotation of the camming member 60. As shown in FIG. 7, the eccentric 61 of the camming member is forced against one of the interior sides 41 or 41' of the yoke legs 45 and 45' of drive member actuator 4. This, in turn, causes partial rotation of the drive member actuator 4 about the axis of the cylindrical opening 43. As explained earlier, this movement of drive member actuator 4 causes rotation of drive member 5 in response to the interactive connection accomplished by ratchet device 50.

From its original position in alignment with the handle 3, the torque arm 2 is rotated through an angle of 90° in order to apply single directional rotation of the drive member actuator 4 and drive member 5. From the 90° angle, the torque arm may then be either returned to alignment with the handle or continually moved another 90° until it forms a 180° angle with the handle. This additional 90° movement of the torque arm in either direction will cause the drive member to rotate in a direction opposite that of the original 90° movement. However, the presence of ratchet device 50 will, upon returning the torque arm 2 to its original position or continuing it to the 180° position, cause drive member actuator 4 to return to its initial position without affecting the rotation of drive member 5 or the fastener.

It is also noted that the torque arm 2 may be positioned in the 180° orientation prior to connection of the wrench with the fastener. This is a very convenient orientation when the reaction arm must be positioned in an area that leaves little room for the rotational movement of the torque arm immediately adjacent to the reaction arm.

It can be seen that the action of the eccentric 61 upon the yoke legs of drive member actuator 4 compounds the leverage applied by the torque arm, thereby multiplying the torque applied to the ratchet device and fastener. The multiplication of this torque will therefore vary depending upon the angle of rotation of eccentric 61 within the constraints of the predetermined spacing between bores 35 and 33 in the clevis.

The torque multiplying characteristics of the wrench are further enhanced by the mechanical relationship between the drive member actuator 4 and the eccentric 61 of the cam member. Specifically, the torque arm 2 can be manipulated, prior to attaching the wrench to a fastener, so that the position of the eccentric 61 can assume any of a number of orientations with respect to the rotational axis of the cam member 60.

Figure 8:
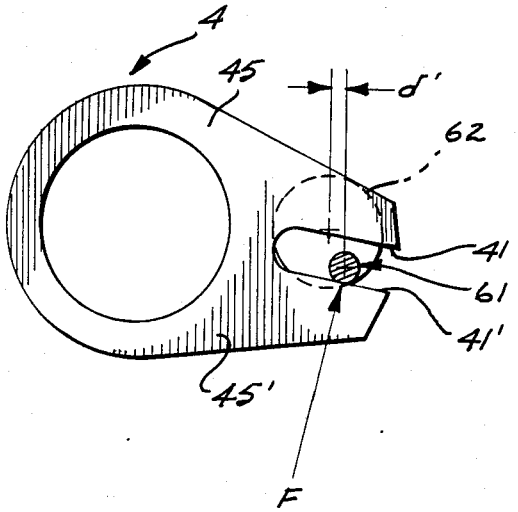

For example, FIG. 7 shows the eccentric positioned so that the lever distance d between the point of resisting force F and the rotational axis of the cam member is at its greatest length. FIG. 8 shows the eccentric positioned so that the lever distance d' is considerably shorter, thereby allowing greater multiplication of the force applied to the cam member by the torque arm (not shown). The design of the cam member and yoke legs allows the eccentric to be positioned to act upon the drive member actuator up to and including the overcenter position—that is, where the lever distance d approaches zero. It can be appreciated that positioning the eccentric in the immediate vicinity of the overcenter position, the force applied to the yoke legs (and, thus, the torque in the drive member itself) is greatly multiplied across the cam member.

The capability of applying force to the cam member up to and including the point of overcenter provides for full exploitation of the torque multiplying feature of the wrench.

Finally, it is noted that the torque-multiplying features of the wrench can also be accomplished by replacing the torque arm connection bracket 63 with either a multisided socket 114 or a multisided stud 124 in FIG. 5 that allows removable attachment of arm 2 when formed with a complementary multisided wrenching device. Further, another embodiment of ratchet device 50 can feature an integrally formed recess in lieu of output stub 53.

It will be understood that various changes in the details, materials and configuration of the wrench which has been herein described and illustrated in order to explain the nature of the invention may be made by those skilled in the art with the principle and scope of the invention as expressed in the appended claims.

The embodiments of the invention in which an exclusive property or privilege is claimed are defined as follows:

1. A torque-multiplying hand wrench, which comprises:

an elongate reaction arm having first and second ends;

a drive member;

drive member actuation means attached to said first end of said reaction arm for rotation about an axis substantially transverse to said arm, said drive member actuation means having a cam engaging portion offset from said axis for receiving a camming force;

cam means attached to said reaction arm adjacent to said drive member for rotation about an axis substantially parallel to the axis of rotation of said drive member, said cam means having an eccentric camming surface shaped and arranged so that rotation of said cam means causes said camming surface to engage said portion of said drive member actuation means to rotate said drive member about its axis relative to said reaction arm; and, torque application means for rotating said cam means relative to said reaction arm, such that torque applied to said cam means is multiplied by the force moment exerted on said drive member by said camming surface acting on said cam engaging portion.

2. The wrench of claim 1, further comprising ratchet means connected between said drive member and said drive member actuation means, such that rotation of said drive member in one direction can be accomplished without complete rotation of said drive member actuation means.

3. The wrench of claim 1, wherein said cam engaging portion also provides the means of attaching said cam means to said reaction arm.

4. The wrench of claim 1, wherein the cam actuation means is rotatable in a full 360° and the camming surface extends circumferentially and eccentrically a full 360° about said axis.

5. The wrench of claims 1, 2, 3 or 4, wherein said torque application means is an elongated handle attached at one end to said cam means.

6. A hand wrench, which comprises:

an elongate reaction arm member having first and second ends, said first end having a bifurcated clevis member integrally formed on its outermost part, said clevis member having substantially flat upper and lower surfaces spaced in substantially parallel relationship, said upper and lower surfaces having a pair of spaced apertures extending orthogonally through both upper and lower surfaces, said pair of apertures including an outermost aperture and an innermost aperture in relation to said reaction arm member;

a drive member actuation means having substantially flat, parallel upper and lower surfaces in a plane parallel to the upper and lower surfaces of said clevis member, said drive member actuation means having a substantially annular portion with a cylindrical opening in said annular portion of approximately the same diameter as said outermost aperture of said clevis member, said drive member actuation means having a yoke portion projecting from said annular portion, said yoke portion having two spaced legs forming an elongated gap projecting radially from said annular portion, said drive member actuation means being positioned between said upper and lower surfaces of said clevis member such that the centerline of said cylindrical void is concentric with the centerline of the outermost aperture in said clevis member;

a cam member having two spaced, concentric, cylindrical guide elements joined by a substantially cylindrical camming portion having a diameter less than that of said cylindrical guide elements, the longitudinal centerline of said camming portion being in eccentric relationship with the longitudinal centerline of said guide elements, said cam member positioned within said innermost aperture so that said camming portion spans the space between the upper and lower surfaces of said clevis member and resides within the elongated gap between said legs of said drive member actuation means;

ratchet means and a fastener drive member residing within the outermost aperture of said clevis member, said ratchet means connected between said fastener drive member and said drive member actuation means so that incremental rotational movement of said drive member actuation means is communicated to said fastener drive member; and, torque applying means for connection to said cam member for rotating said cam member, thereby causing rotation of said camming portion and actuation of said drive member actuation means.

7. The wrench of claim 6, wherein the torque applying means comprises an elongated lever arm, one end of which is attached to said crank member.

8. The wrench of claim 6, wherein the reaction arm includes means for securing said torque arm to said reaction arm.

9. The wrench of claim 6, wherein the torque applying means comprises a multisided recess in said guide element for receiving a multisided wrenching device.

10. The wrench of claim 6, wherein the force application means comprises a multisided protrusion from one said guide element that accommodates multisided wrenching devices.

* * * * *